US005292079A

United States Patent [19]

Zakohji

[11] Patent Number: 5,292,079

[45] Date of Patent: Mar. 8, 1994

[54] CONCRETE BREAKER WITH PROTECTIVE COVER

[75] Inventor: Nobuyuki Zakohji, Osaka, Japan

[73] Assignee: Ohyodo Diesel Co., Ltd., Osaka, Japan

[21] Appl. No.: 975,683

[22] Filed: Nov. 13, 1992

[30] Foreign Application Priority Data

Aug. 10, 1992 [JP] Japan ..... 4-212638

[51] Int. Cl.[5] ..... B02C 1/04

[52] U.S. Cl. ..... 241/264; 241/101.7; 299/85; 299/88; 414/740

[58] Field of Search ..... 241/101.7, 264, 266; 30/134; 125/23.01; 299/67, 85, 88; 225/103; 414/739, 740; 294/106, 902

[56] References Cited

U.S. PATENT DOCUMENTS

| | | | |
|---|---|---|---|
| 4,776,524 | 10/1988 | Sakato | 241/101.7 |
| 4,951,886 | 8/1990 | Berto | 241/101.7 |
| 4,961,543 | 10/1990 | Sakato et al. | 241/101.7 X |
| 5,004,168 | 4/1991 | Purser | 241/101.7 |
| 5,004,569 | 9/1991 | LaBounty et al. | 241/101.7 X |
| 5,065,514 | 11/1991 | Gross | 30/134 |
| 5,183,216 | 2/1993 | Wack | 241/101.7 |

FOREIGN PATENT DOCUMENTS

| | | | |
|---|---|---|---|
| 3731734 | 4/1989 | Fed. Rep. of Germany . | |
| 2648365 | 12/1990 | France . | |
| 214670 | 8/1989 | Japan | 241/101.7 |
| 2234452 | 2/1991 | United Kingdom | 241/101.7 |

*Primary Examiner*—Hien H. Phan
*Assistant Examiner*—Clark F. Dexter
*Attorney, Agent, or Firm*—Pollock, Vande Sande & Priddy

[57] ABSTRACT

A lower jaw 4 is tiltably connected to the front end of a swing arm 3, an upper jaw 6 openably and closably connected to the lower jaw 4, a hydraulic cylinder 8 interposed between the upper and lower jaws to open and close the jaws, and a protective cover 11 connected to the lower jaw 4 by a link 12 and to the upper jaw 6 by a pin and adapted to follow the opening and closing movement of the upper jaw 6 by a pin while covering the piston rod 10 of the hydraulic cylinder 8. A plurality of straight lower cutting blades are formed on the upper surface of the front end of the lower jaw 4 and a plurality of pointed upper cutting blades 7 are formed on the lower surface of the front end of the upper jaw 6. These upper and lower cutting blades are disposed to mesh with each other in zigzags as viewed from the side. When the upper and lower jaws are closed, concrete is finely broken in the clearances between the upper and lower cutting blades.

2 Claims, 9 Drawing Sheets

CONCRETE BREAKER WITH PROTECTIVE COVER

BACKGROUND OF THE INVENTION

The present invention relates to a concrete breaker used for demolishing buildings.

As means for breaking iron-reinforced concrete buildings, bridges and the like, and as means for crushing concrete blocks of a demolished concrete building into pieces, use has been made of an open-close jaw type concrete breaker. Such concrete breaker breaks concrete blocks by a pair of upper and lower jaws of steel which open and close. A conventional concrete breaker of this type will now be described with reference to FIGS. 9 and 10.

A concrete breaker shown in FIG. 9 is the one disclosed in Japanese Utility Model Publication [Kokoku] No. 28839/1986 and Japanese Utility Model Application Disclosure [Kokai] No. 177258/1985, and comprises a swing arm 3 rotatably connected to the front end of a boom 2 tiltably extending from a working machine 1 and a lower jaw 61 and an upper jaw 62 openably and closably connected to the front end of said swing arm 3. The boom 2 is vertically swung by a hydraulic cylinder 15, while the swing arm 3 is driven back and forth by a hydraulic cylinder 16 attached to the boom 2.

The lower jaw 61 is rotatably connected at its rear end to the front end of the swing arm 3 by a pin 70. The rear end of the lower jaw 61 is connected through a link mechanism 72 to the front end of the piston rod 71 of a hydraulic cylinder 17 attached to the swing arm 3. The lower jaw 61 is turned back and forth by the hydraulic cylinder 17. The rear end of the upper jaw 62 is rotatably connected to the middle portion of the lower jaw 61 by a pin 63. The upper jaw 62 is pivotally moved (for opening and closing) with the pin 63 serving as a fulcrum at the position where it is opposed to the front end of the lower jaw 61. The opening and closing movement of the upper jaw 62 is performed by a hydraulic cylinder 64 attached between the lower and upper jaws 61 and 62.

As shown in FIG. 10, the lower jaw 61 has lower cutting blades 65 in the form of a lattice at the front end and the upper jaw has a plurality of projection-like upper cutting blades 66. As shown in FIG. 10(*a*), with the upper jaw 62 opened, a concrete block 18 is pushed into the space between the lower and upper jaws 61 and 62 and the upper jaw 62 is closed toward the front end of the lower jaw 61 by the hydraulic cylinder 64, whereby the concrete block 18 is broken by the lower and upper cutting blades 65 and 66, as shown in FIG. 10(*b*). Most of the broken pieces 18' from the concrete block 18 fall through openings 67 defined by the lattice-like lower cutting blades 65 of the lower jaw 61. The broken pieces 18' are further broken for various uses.

The concrete breaker of the opening and closing type described above has the following problems.

Since broken pieces 18' have to be allowed to fall through the openings 67, if the size of the openings 67 is decreased to that of ballast, then clogging tends to occur. If the size of said openings is set at a value well above the size of ballast, then the broken pieces 18' fall through the openings 67 before they are finely broken, with the result that the average size of the broken pieces 18' becomes greater than that of ballast. Therefore, if the broken pieces 18' are to be used as ballast, they have to be broken by separate concrete breaking means, this operation being troublesome.

Since the front end of the lower jaw 61 is the region where the openings 67 are formed and hence it has a lower mechanical strength, thick steel material has to be used for the lattice-like lower cutting blades 65 themselves and their support means and reinforcing means. As a result, the lower jaw increases in size, becoming heavier.

The piston rod 68 of the hydraulic cylinder 64 for opening and closing the upper jaw 62 with respect to the lower jaw 61 is exposed and hence is liable to be damaged or contaminated as it hits against a concrete wall at the work site during concrete breaking operation. To prevent such a drawback, a protective cover (not shown) which entirely covers the hydraulic cylinder 64 is fixed on the lower jaw 61, as is practiced in some concrete breakers of the opening and closing jaw type. However, the installation of such protective cover increases the size of the entire jaw and interferes with concrete breaking operation, making it impossible to perform concrete breaking operation in narrow spaces.

SUMMARY OF THE INVENTION

The present invention provides a concrete breaker comprising a lower jaw tiltably pin-connected to the front end of a swing arm extending from a working machine, with a plurality of lower cutting blades disposed at intervals to project from the upper side of the front end portion of said lower jaw. An upper jaw is vertically openably and closably pin-connected to said lower jaw, with a plurality of upper cutting blades disposed at intervals to project from the lower side of the front end portion of said lower jaw, a hydraulic cylinder comprising a cylinder body connected to the rear end portion of the lower jaw and a piston rod extending from the cylinder body and connected at its front end to the upper jaw. The advance or retraction movement of said piston rod vertically drives said upper jaw relative to said lower jaw for opening or closing movement, a protective cover with a link pin-connected at one end thereof to the lower jaw and at the other end to the rear end of said protective cover, the front end of said protective cover being pin-connected to the upper jaw, said protective cover being swung in conjunction with the upper jaw in the opening and closing direction of the upper jaw at a position where it always covers the outer side of the hydraulic piston. And with this breaker the present invention solves the above problems.

Further, it is desirable from the standpoint of breaking concrete more reliably and finely, that the lower cutting blades of the lower jaw be a plurality of substantially parallel straight cutting blades and that the upper cutting blades of the upper jaw be different kinds of cutting blades including sharp cutting blades adapted to be entered between and to mesh with the lower cutting blades of the lower jaw when the upper jaw is closed with respect to the lower jaw.

When concrete is broken by the lower cutting blades fixed on the upper surface of the front end region of the lower jaw and the upper cutting blades of the upper jaw, first the concrete is broken into large pieces by the upper and lower cutting blades and then finer pieces by the clearances between the upper and lower cutting blades that mesh with each other in zigzags. Further, the front end of the lower jaw having the lower cutting blades fixed thereto has an increase in mechanical strength by an amount corresponding to the lack of openings, so that the lower jaw can be made in small box form using thin steel plate.

Further, the protective cover which follows the opening and closing movement of the upper jaw is a small-sized one just to cover the piston rod of the hydraulic cylinder for opening and closing the jaw, not interfering with concrete breaking operation.

BRIEF DESCRIPTION OF THE DRAWINGS

FIG. 5(*b*) is a bottom view of the upper jaw;

FIG. 10(*b*) is a side view including a partial section showing jaw closing operation.

DESCRIPTION OF THE PREFERRED EMBODIMENTS

Figure 1:
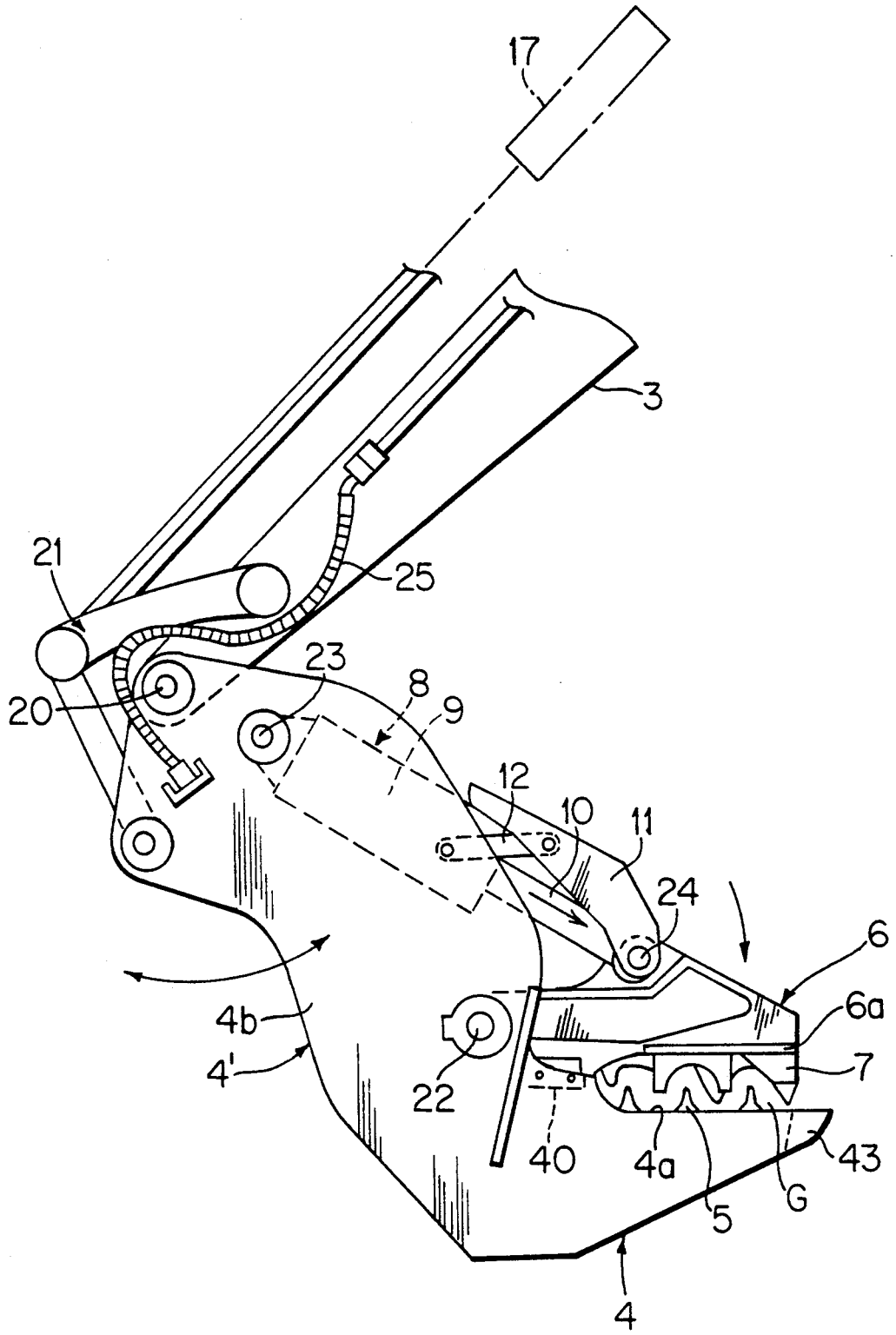
FIG. 1 is a side view of the principal portion, showing an embodiment of the present invention.

An embodiment will now be described with reference to FIGS. 1 through 8. A concrete breaker shown therein comprises a lower jaw-equipped frame 4' and an upper jaw 6 which are openably and closably pin-connected to the front end of the swing arm 3 of a working machine 1. A jaw opening and closing hydraulic cylinder 8 is installed between the lower jaw 4 integral with the frame 4' and the upper jaw 6, and a protective cover 11 is installed at a position covering its piston rod 10.

The frame 4' integrally having the lower jaw 4 at its front end is tiltably connected to the front end of the swing arm 3. The tilting movement of the frame 4' and lower jaw 4 is effected by a hydraulic cylinder 17 and a link mechanism 21. A flat lower breaking plate 4*a* is fixed to the front end of the lower jaw 4, and a plurality of lower cutting blades 5 are provided at fixed intervals on said lower breaking plate.

The upper jaw 6 is vertically rotatably connected at its rear end to the rear end of the lower jaw 4 by a pin 22. The upper jaw 6 has a plurality of kinds of upper cutting blades 7 provided on its lower surface opposed to the front end of the lower jaw 4. The upper cutting blades 7 are arranged such that when the upper jaw 6 is closed with respect to the lower jaw 4, as shown in FIG. 1, the upper cutting blades 7 mesh with the lower cutting blades 5 with each upper cutting blade 7 entering between adjacent lower cutting blades 5.

The jaw opening and closing hydraulic cylinder 8 is rotatably connected at its cylinder body 9 to the rear end of the lower jaw by pin 23 and the piston rod 10 extending from the cylinder body 9 is rotatably pin-connected substantially to the middle of the upper jaw 6 by pin 24. When the piston rod 10 is retracted into the cylinder body 9, the upper jaw 6 is opened, and when the piston rod 10 is advanced, the upper jaw 6 is closed. The driving of the hydraulic cylinder 8 is effected by using a flexible oil pipe 25 connected to the lateral surface of the rear end of the frame 4'.

The protective cover 11 is long enough to cover the piston rod 10 projecting from the cylinder body 9 to the greatest extent and is U-shaped in cross section. The protective cover 11, together with the piston rod 10, is rotatably pin-connected at its front end to the upper jaw 6 and at its rear end substantially to the middle of the frame 4' by a link 12. The opposite ends of the link 12 are rotatably pin-connected to the frame 4' and protective cover 11.

Figure 2:
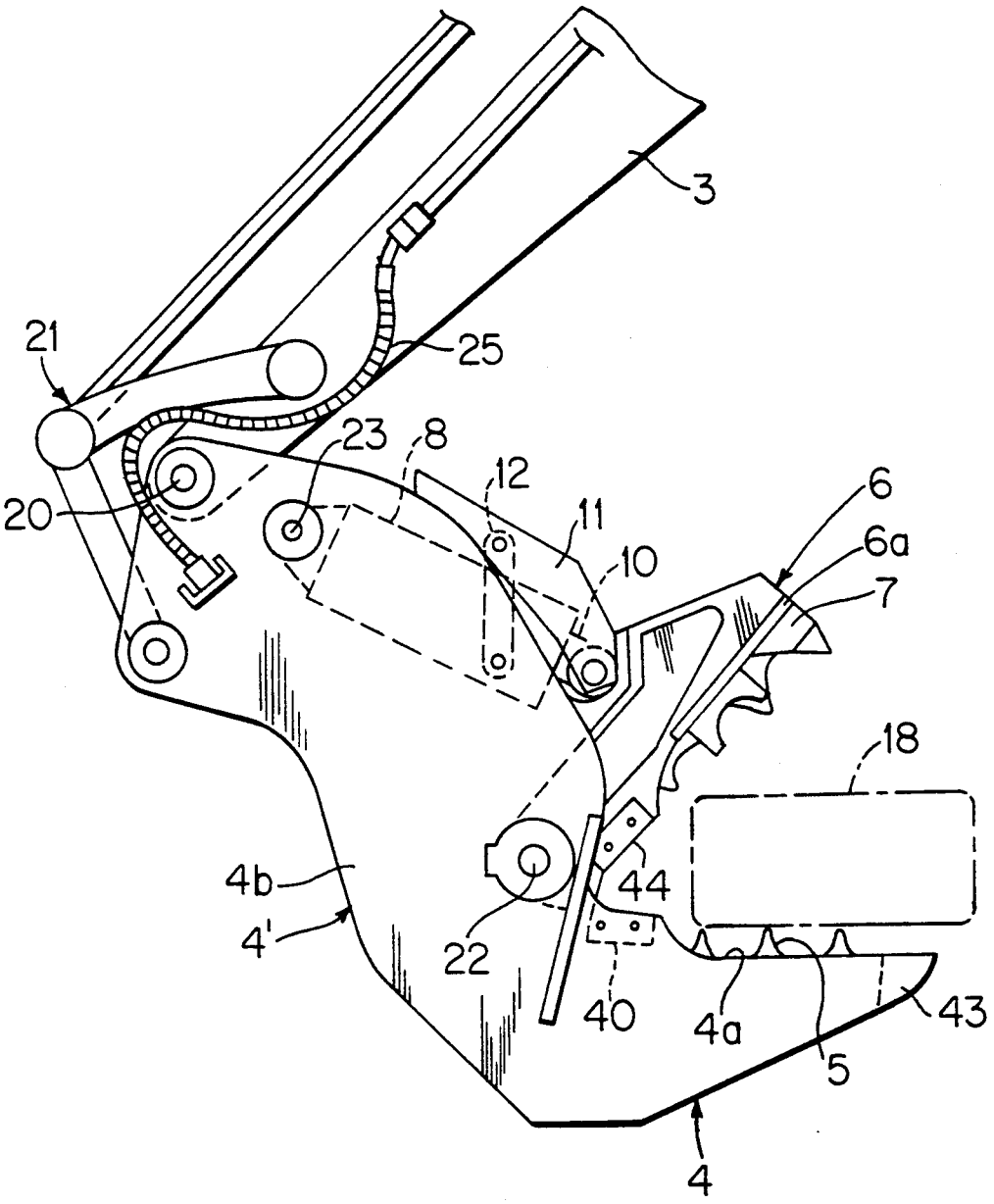
FIG. 2 is a side view showing the jaw opening operation of the concrete breaker of FIG. 1.

The protective cover 11 swings to cover the piston rod 10 as it follows the opening and closing movement of the upper jaw 6. As shown in FIG. 1, when the upper jaw 6 is in the closed position, the protective cover 11 covers the region extending from the front end of the piston rod 10 to the outer end of the cylinder body 9, and when the upper jaw is opened, following this opening movement the protective cover 11 swings backward toward the cylinder body 9 to cover the region adjacent to the outer side of the cylinder body 9, as shown in FIG. 2.

The piston rod 10 of the jaw opening and closing hydraulic cylinder 8 is hidden and protected by such protective cover 11, thus avoiding the danger of being damaged by hitting a concrete wall or the like during concrete breaking operation. Further, the protective cover 11 swings along the hydraulic cylinder 8 as it follows the upper jaw 6, thereby locally covering the region necessary for protection of the hydraulic cylinder 8; thus, a small-sized cover which is short in length can be applied. This small-sized protective cover 11 does not interfere with concrete breaking operation and makes it possible to design the concrete breaking portions of the lower and upper jaws 4 and 6 in compact form.

Figure 3:
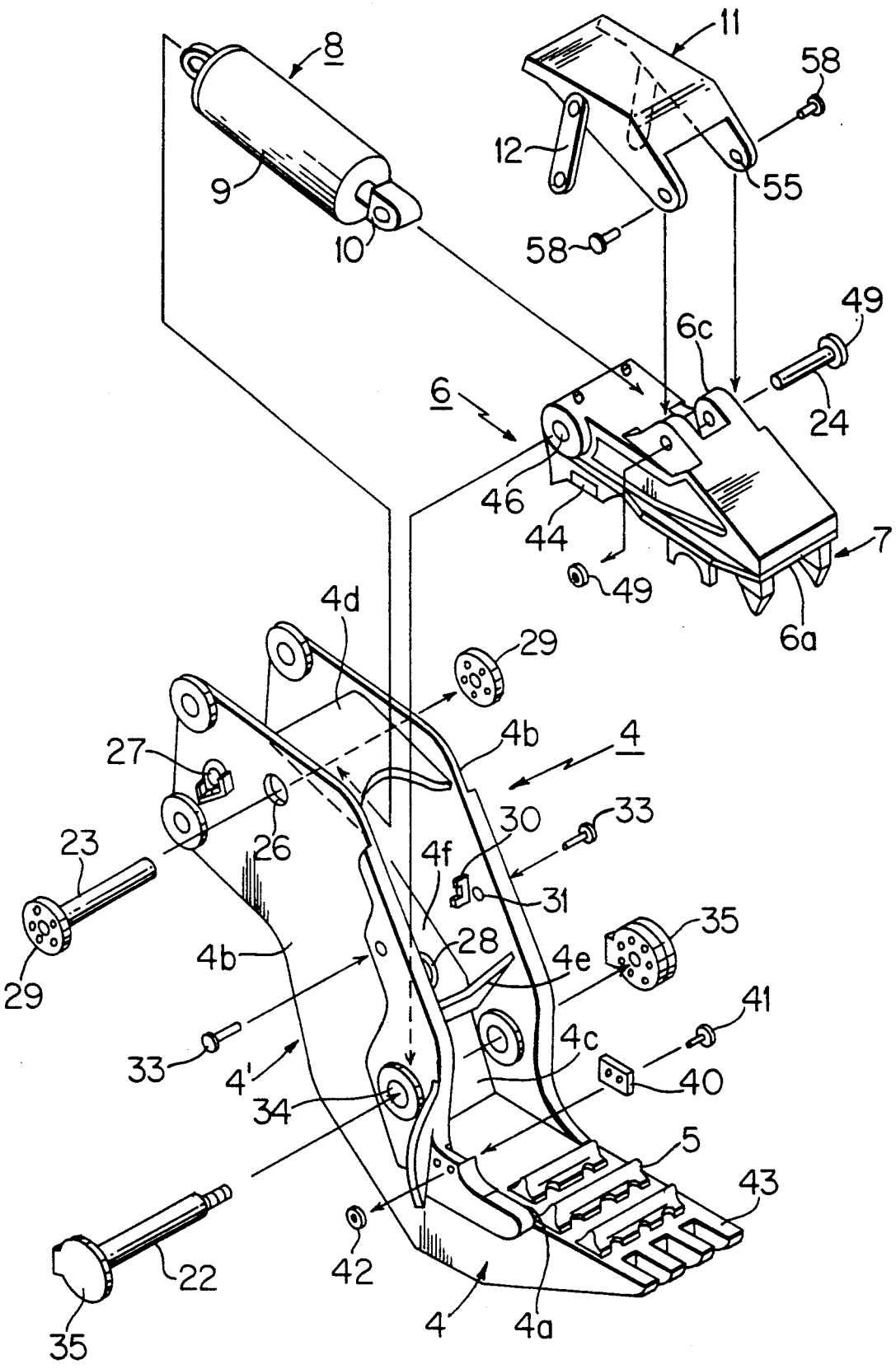
FIG. 3 is an exploded perspective view of the entire concrete breaker of FIG. 1.
Figure 4:
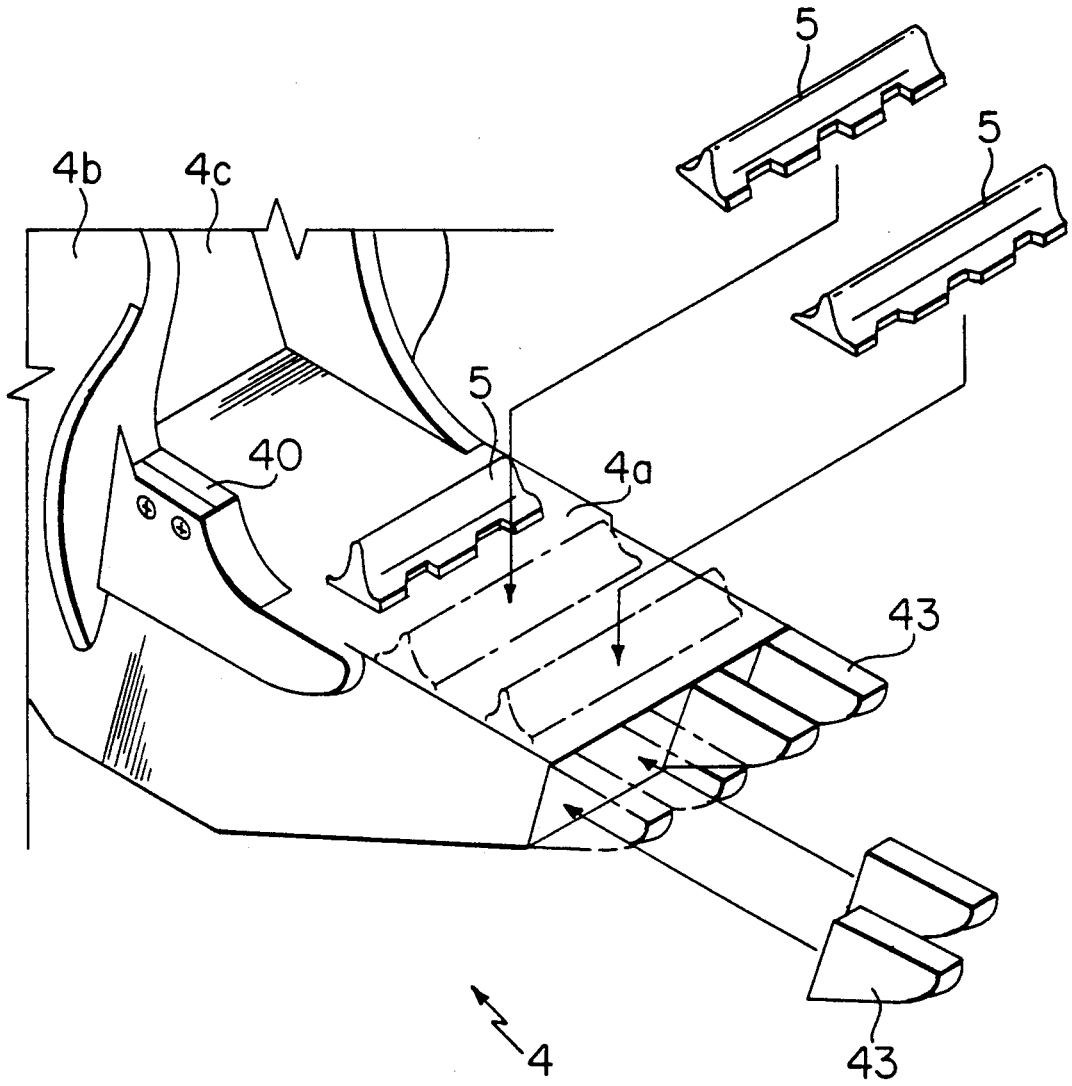
FIG. 4 is a fragmentary perspective view of the lower jaw and lower cutting blades of the concrete breaker of FIG. 1.

An example of the lower jaw 4 will now be described with reference to FIGS. 3 and 4. The frame 4' integral with the lower jaw 4 comprises a pair of lateral walls 4*b* of steel plate, a bottom plate 4*c* connecting them, and reinforcing plates 4*d*, 4*e* and 4*f*, and the front ends of extensions of the lateral walls 4*b* are connected by a lower breaking plate 4*a*. The rear ends of the lateral walls 4*b* are formed with pin holes 26 for receiving the pin 23 for the jaw opening and closing hydraulic cylinder 8 and holes 27 for attaching the oil pipe 25. The reinforcing plate 4*f* is formed with a working hole 28, which is utilized to attach or adjust the hydraulic cylinder 8.

With the hydraulic cylinder 8 inserted in the rear ends of the lateral walls 4*b*, the pin 23 is inserted into the pin holes 26 to extend through the cylinder body 9. This pin 23 is fixed at its opposite ends to the lateral walls 4*b* by pin holders 29. The pin holders 29 are fixed to the lateral walls 4*b* with set screws.

The intermediate inner surfaces of the lateral walls 4*b* are formed with link stoppers 30 projecting therefrom and pin holes 31 are formed adjacent to said link stoppers. Inserted in said pin holes 31 are stepped pins 32 (FIG. 8) inserted in the lower ends of the links 12 of the protective cover 11 and connected thereto by bolts 33.

To prevent the bolts 33 from being loosened owing to vibrations, the stepped pins 32 are fixed to the link turning stoppers 30 so that they will not turn.

The portions of the lateral walls 4b adjacent to their front ends are formed with pin holes 34 for receiving the pin 22 of the upper jaw 6. The rear end of the upper jaw 6 is inserted adjacent to the front ends of the lateral walls 4b and the pin 22 is inserted into the pin holes 34 through the rear end of the upper jaw 6. The pin 22 is supported by pin receivers 35 on the lateral walls 4b.

An iron reinforcement cutting blade 40 is fixed on the front inner surface of one of the two lateral walls 4b with screws 41 and nuts 42. The blade 40 serves to cut iron reinforcements in iron reinforced concrete and is fixed on one side of the innermost region of the lower breaking plate 4a.

The front end of the lower jaw 4 is provided with a plurality of talons 43 like bears' disposed at equal intervals. The talons 43 are flush with the upper surface of the lower breaking plate 4a and welded to the front surface of the lower breaking plate 4a. The talons 43 serve to gather or dig up concrete blocks and the like, and if they are worn out, they will be thermally cut and replaced by fresh talons.

Figure 5A:
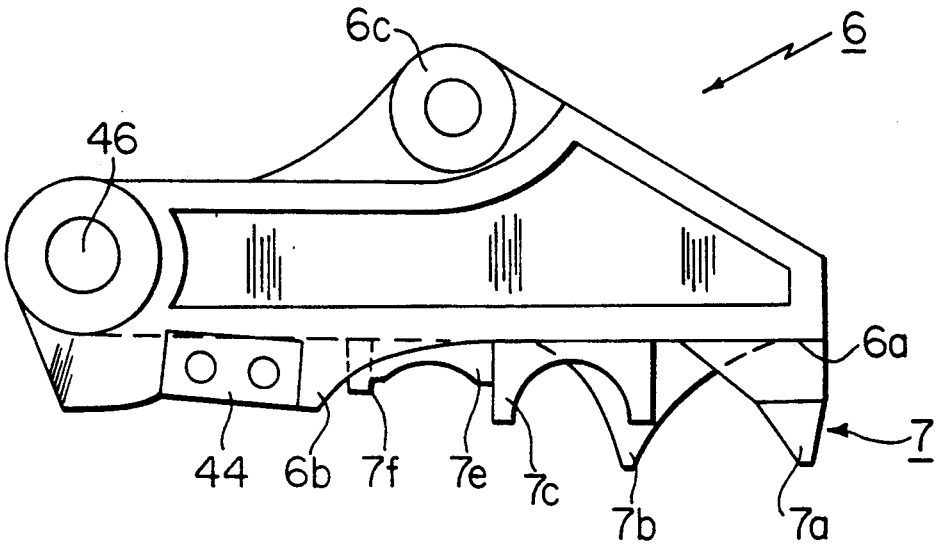
FIG. 5(*a*) is a side view of the upper jaw in the concrete breaker of FIG. 1.
Figure 5B:
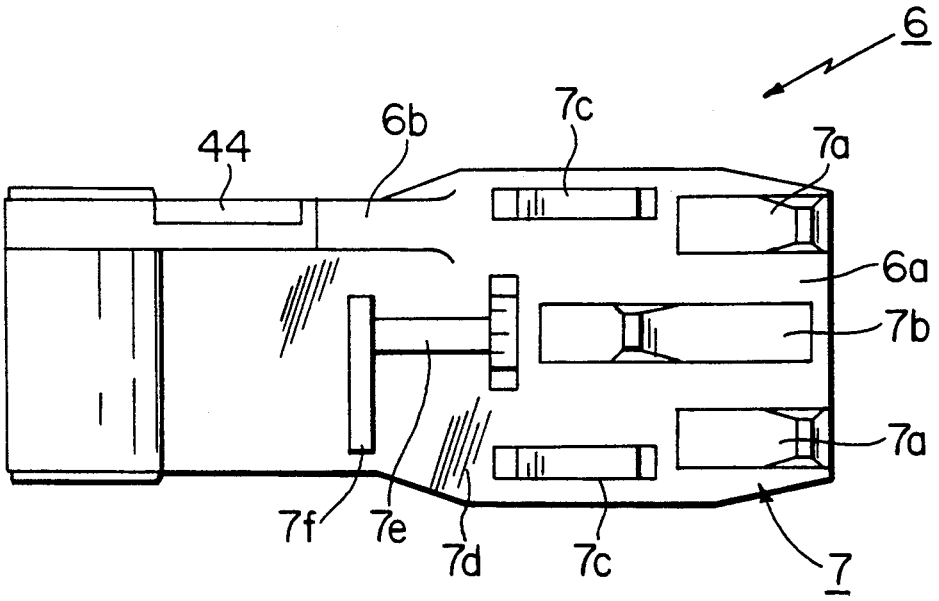
Figure 6A:
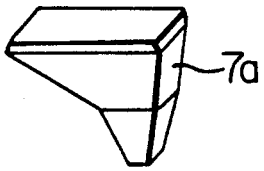
FIG. 6 is a perspective view showing 6 examples of the upper cutting blades of the upper jaw of FIG. 5.
Figure 6B:
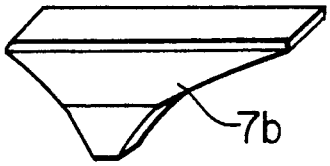
Figure 6C:
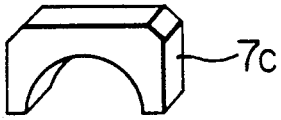
Figure 6D:
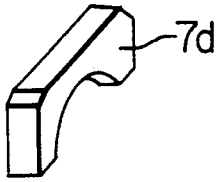
Figure 6E:
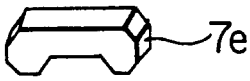
Figure 6F:
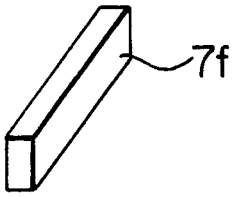

Examples of the upper jaw 6 and upper cutting blades 7 will now be described with reference to FIGS. 5 and 6. The lower surface of the upper jaw 6 is defined by a flat substantially rectangular upper breaking plate 6a, with a total of 8 upper cutting blades 7 welded thereto. The upper cutting blades 7 are arranged to mesh with the lower cutting blades 5 such that they do not abut against the lower cutting blades 5 but such that each fits between adjacent lower cutting blades. The upper cutting blades 7 are divided into 6 classes, first to sixth upper cutting blades 7a–7f.

The first upper cutting blades 7a are in the form of sharp cutting blades as shown in FIG. 6(*a*) and such a pair is welded to the opposite sides of the front end of the upper breaking plate 6a. The second upper cutting blade 7b is in the form of a sharp cutting blade as shown in FIG. 6(*b*) and is welded to the middle of the front end of the upper breaking plate 6a. The third upper cutting blades 7c are of the gate type as shown in FIG. 6(*c*) and such a pair is welded adjacent to and rearwardly of the first upper cutting blades 7a of the upper breaking plate 6a. The fourth upper cutting blade 7d is of the small gate type as shown in FIG. 6(*d*) and is welded adjacent to and rearwardly of the second upper cutting blade 7b of the upper breaking plate 6a. The fifth upper cutting blade 7e is of the square bar type as shown in FIG. 6e with projections on the opposite ends thereof and is welded rearwardly of the fourth upper cutting blade 7d of the upper breaking plate 6a. The sixth upper cutting blade 7f is of the square bar type as shown in FIG. 6(*f*) and is welded rearwardly of the fifth upper cutting blade 7e of the upper breaking plate 6a.

As for the projecting lengths of the upper cutting blades 7a–7f by which they project from the upper breaking plate 6a, the first and second upper cutting blades 7a and 7b are the longest, followed by the third and fourth upper cutting blades 7c and 7d, the fifth and sixth upper cutting blades 7e and 7f being shortest.

One side of the innermost region of the upper breaking plate 6a is formed with a lateral wall 6b of substantially the same height as that of the sixth upper cutting blade 7f, said lateral wall 6b having an iron reinforcement cutting blade 44 fixed thereto with screws 45. The cutting blade 44 makes a pair with the cutting blade 40 of the lower jaw 4 and, as shown in FIG. 2, when the upper and lower jaws are opened, the upper and lower cutting blades 40 and 44 are also in the opened state, and when the upper and lower jaws are closed, as shown in FIG. 1, the upper and lower cutting blades 40 and 44 are closed, crossing each other, during which time iron reinforcements (not shown) are cut.

Figure 7:
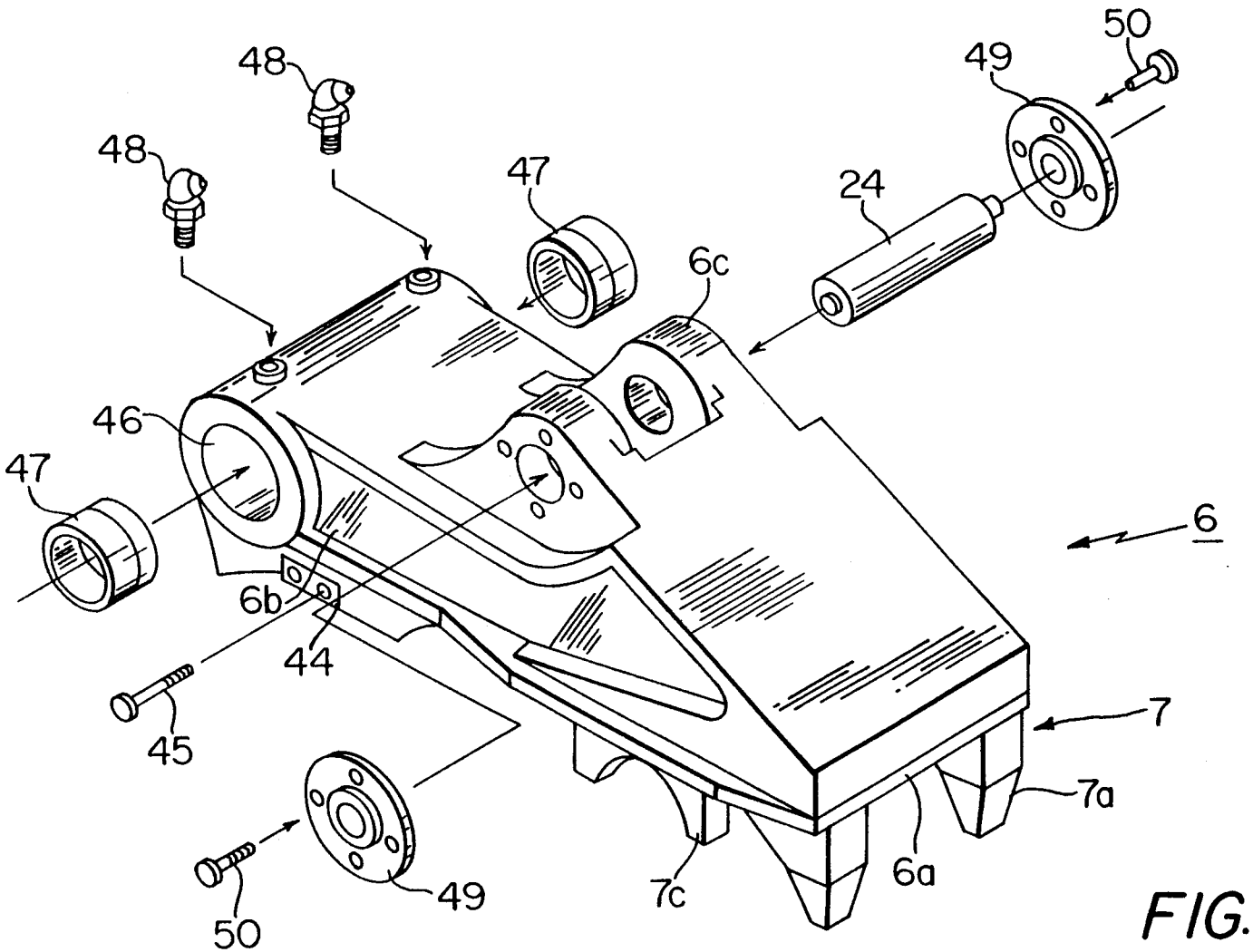
FIG. 7 is an exploded perspective view of the upper jaw of FIG. 5 and its attaching parts.

As shown in FIG. 7, the upper jaw 6 has a pin hole 46 in the rear end for receiving the pin 22. Rings 47 are fitted in the opposite ends of the pin hole 46, serving to rotatably support the opposite ends of the pin 22. Grease nipples 48 are attached to the rear end of the upper jaw 6 to feed grease between the rings 47 and the pin 22. The rings 47 will be replaced when they are worn out.

The upper central region of the upper jaw 6 is formed with a pair of bearing portions 6c for receiving the pin 24 which is used to connect the piston rod 10 of the hydraulic cylinder 8 and the protective cover 11. The pin 24 is supported at its opposite ends by pin supports 49 fixed to the outer surfaces of the bearing portions 6c with screws 50.

Figure 8:
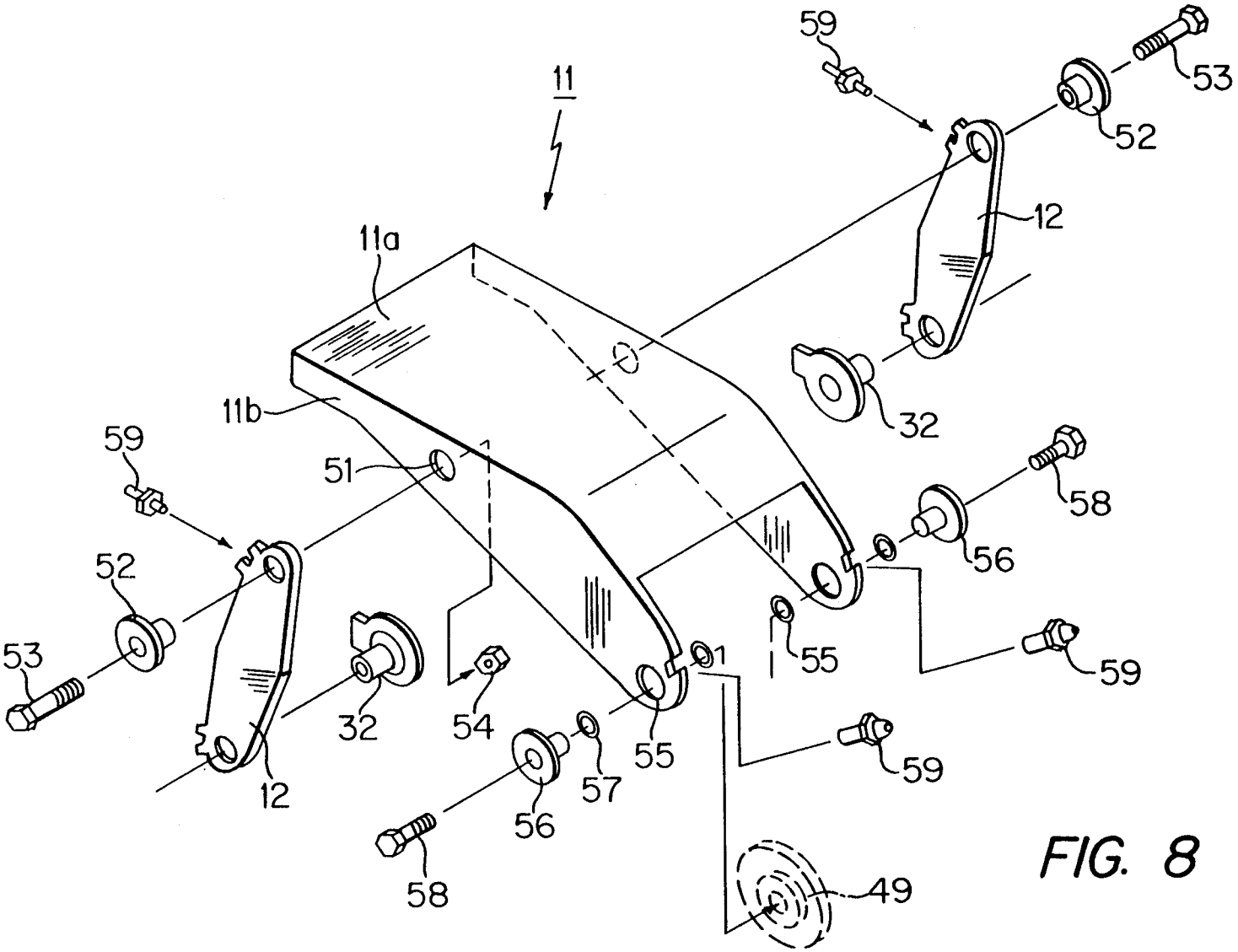
FIG. 8 is an exploded perspective view of a protective cover and its attaching parts in the concrete breaker of FIG. 1.
Figure 9:
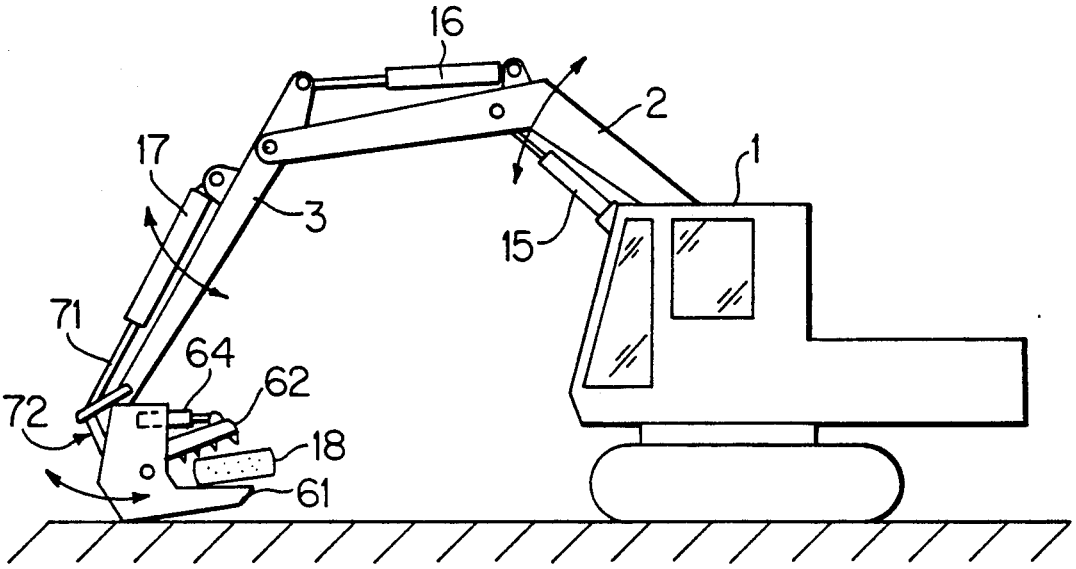
PRIOR ART FIG. 9
FIG. 9 is a side view of a conventional concrete breaker.
Figure 10A:
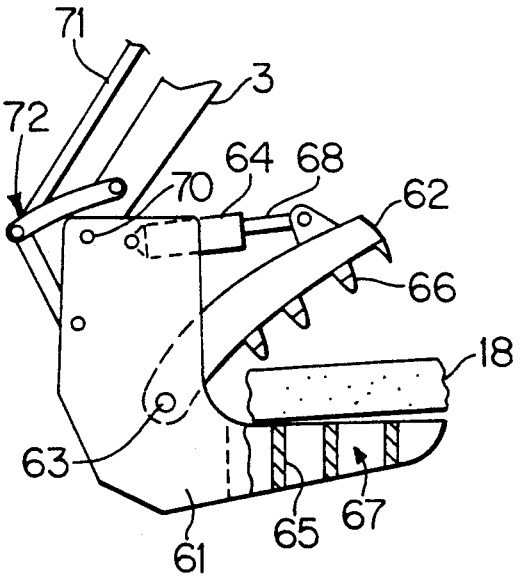
PRIOR ART FIG. 10(a)
FIG. 10(*a*) is a side view including a partial section, showing jaw opening operation in the concrete breaker of FIG. 9.
Figure 10B:
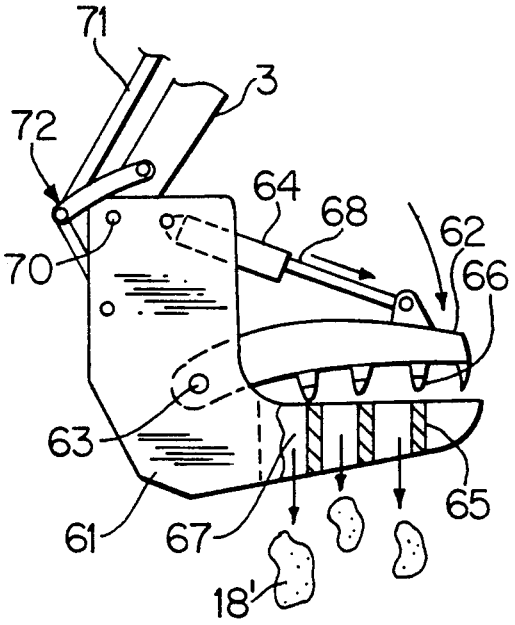
PRIOR ART FIG. 10(b)

An example of the protective cover 11 is shown in FIG. 8. This protective cover has lateral plates 11b on the opposite sides of the cover body 11a of sheet metal. Each lateral plate 11b has a pin hole 51 formed substantially in the middle thereof, and a stepped pin 52, which is passed through the upper end of the link 12, is inserted in said pin hole 51. The stepped pin 52 is attached to the lateral plate 11b by a screw 53 and a nut 54.

Stepped pins 56 are inserted in pin holes 55 formed in the front ends of the two lateral plates 11b through dust preventing O-rings 57. The front ends of the lateral plates 11b are mounted outside the pin supports 49 fixed to the bearing portions 6c of the upper jaw 6 with screws and the stepped pins 56 are inserted in the pin supports 49 and fixed thereto with screws 58. Grease nipples 59 are joined to the rotatable portions at the front ends of the lateral plates 11b and the opposite ends of the links 12 to ensure smooth rotation in the respective portions.

The breaking of concrete by the concrete breaker of the construction described above is effected in the following manner: As shown in FIG. 2, with the upper jaw 6 fully opened with respect to the lower jaw 4, a concrete block 18 is put therebetween. In this state, as the hydraulic cylinder 8 is actuated to close the upper jaw 6 toward the lower jaw 4, the first and second cutting blades 7a and 7b of great projecting length in the upper jaw 6 break the concrete block 18 into large pieces. Since the first and second cutting blades 7a and 7b and the lower cutting blades 5 are alternately disposed, the concrete block 18 is reliably broken by the breaking force produced by the cutting blades cutting thereinto.

As the upper jaw 6 is closed, the concrete block 18 is broken into pieces of intermediate size and when the upper cutting blades 7 are closest to the lower breaking plate 4a, the concrete block 18 is finely broken in ballast size. That is, in the FIG. 1 state, the upper and lower cutting blades 5 and 7 mesh with each other with a clearance G defined therebetween, the concrete block 18 is reliably broken in a size not more than the clearance G. At this time, the upper and lower breaking plates 4a and 6a also serve for concrete breaking. The broken pieces of the concrete block fall down from between the upper and lower jaws.

The lower breaking plate 4a which performs such concrete breaking is in the form of a single steel plate with no opening, strongly fixing the lower cutting blades 5 even if there is no reinforcing means. Therefore, weight decrease can be easily attained in that the lower jaw 4 having the lower breaking plate 4*a* provided at its front end and the frame 4' can be made in box form.

In addition, the present invention is not limited to the above embodiment. For example, the lower cutting blades 5 of the lower jaw 4 may be fixed to extend parallel with the direction of the jaw length.

According to the present invention, when concrete is gripped and broken between the lower cutting blades of the lower jaw and the upper cutting blades of the upper jaw, it is broken into large pieces by the upper and lower cutting blades and then into fine pieces in the clearances between the upper and lower cutting blades meshing with each other in zigzags; thus, the concrete can be broken in ballast size. As a result, the concrete can be utilized as ballasts immediately after it has been broken. Thus, a concrete breaker which is convenient for users may be presented.

The front end of the lower jaw to which the lower cutting blades are attached can be constructed of plate metal of sufficient mechanical strength with no opening. The entire lower jaw is made of thin steel plate in box form; thus, there is provided a concrete breaker which is small in size and light in weight, having high operating efficiency.

Further, the protective cover which follows the opening and closing movement of the upper jaw is small-sized and fully protects the piston rod of the jaw opening and closing hydraulic cylinder. And since this small-sized protective cover does not interfere with concrete breaking operation, there is provided a concrete breaker which is capable of easily and efficiently performing concrete breaking operation even in narrow spaces.

What is claimed is:

1. A concrete breaker comprising:

a lower jaw tiltably pin-connected to a front end of a swing arm extending from a working machine, a plurality of lower cutting blades disposed at intervals and projecting from an upper side of a front end portion of said lower jaw, an upper jaw pivotably pin-connected to said lower jaw such that a lower side of a front end portion of said upper jaw opposes said upper side of said lower jaw, said upper jaw having a plurality of upper cutting blades disposed at intervals and projecting from the lower side of the front end portion of said upper jaw, a hydraulic cylinder comprising a cylinder body connected to a rear end portion of the lower jaw and a piston rod extending from the cylinder body, said piston rod connected at its front end to the upper jaw, an advance and retracting movement of said piston rod pivotably driving said front end portion of said upper jaw toward and away from said front end portion of said lower jaw for closing and opening movement, respectively, a protective cover with a link wherein said link has two ends and is pin-connected at one end to the lower jaw and at the other end to a rear end of said protective cover, a front end of said protective cover being pin-connected to the upper jaw such that the protective cover extends along an outer side of the piston rod, said protective cover being swung in conjunction with the upper jaw in the opening and closing direction of the upper jaw at a position where it always covers the outer side of the piston rod.

2. A concrete breaker as set forth in claim 1, characterized in that the lower cutting blades of the lower jaw are a plurality of substantially parallel straight cutting blades and the upper cutting blades of the upper jaw are various kinds of cutting blades including sharp cutting blades adapted to be entered between and to mesh with the lower cutting blades of the lower jaw when the upper jaw is closed with respect to the lower jaw.

* * * * *